US008971735B2

(12) United States Patent
Yoshimura

(10) Patent No.: US 8,971,735 B2
(45) Date of Patent: Mar. 3, 2015

(54) IMAGE HEATING APPARATUS CONFIGURED TO DETECT BREAKAGES OF LATERAL END PORTIONS OF AN ENDLESS BELT

(71) Applicant: Canon Kabushiki Kaisha, Tokyo (JP)

(72) Inventor: Tomohiko Yoshimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 13/859,188

(22) Filed: Apr. 9, 2013

(65) Prior Publication Data

US 2013/0279926 A1 Oct. 24, 2013

(30) Foreign Application Priority Data

Apr. 23, 2012 (JP) ..... 2012-097326

(51) Int. Cl.
*G03G 15/20* (2006.01)

(52) U.S. Cl.
CPC ..... *G03G 15/205* (2013.01); *G03G 15/2017* (2013.01); *G03G 2215/00143* (2013.01); *G03G 2215/00156* (2013.01); *G03G 2215/2022* (2013.01)
USPC ..... 399/33

(58) Field of Classification Search
USPC ..... 399/33, 329
See application file for complete search history.

(56) References Cited

U.S. PATENT DOCUMENTS

| | | | | |
|---|---|---|---|---|
| 7,986,893 | B2 * | 7/2011 | Condello | 399/33 |
| 8,107,867 | B2 * | 1/2012 | Funabiki | 399/329 |
| 8,295,748 | B2 | 10/2012 | Okamoto | |
| 8,639,131 | B2 * | 1/2014 | Peng et al. | 399/33 |
| 2011/0026983 | A1 | 2/2011 | Okamoto | |

FOREIGN PATENT DOCUMENTS

| | | | |
|---|---|---|---|
| JP | 2002-287542 | A | 10/2002 |
| JP | 2004-341346 | A | 12/2004 |
| JP | 2011-033832 | A | 2/2011 |

* cited by examiner

*Primary Examiner* — William J Royer
(74) *Attorney, Agent, or Firm* — Fitzpatrick, Cella, Harper & Scinto

(57) ABSTRACT

A belt failure detecting mechanism includes a rocking arm connected to a ground contact portion and an urging member configured to urge one end of the rocking arm against an inner surface of an end of a heating belt. When the end of the heating belt is not broken, the end of the rocking arm is in contact with the inner surface of the end of the heating belt, and the other end of the rocking arm does not contact to a detection switch so that an electric power is supplied to a heating device. When the end of the heating belt is broken, the end of the rocking arm is displaced to an outer side of the heating belt so that the other end of the rocking arm contacts to an electric element so that a fuse is blown to stop the electric power supplied to the heating device.

10 Claims, 9 Drawing Sheets

FIG. 4B

| POSITION OF HEATING BELT | +3.0 mm | +1.0 mm | CENTRAL AREA | -1.0 mm | -3.0 mm |
|---|---|---|---|---|---|
| | FAR SIDE | | | NEAR SIDE | |
| | STOP OF APPARATUS | ANGLE CHANGING POSITION | | ANGLE CHANGING POSITION | STOP OF APPARATUS |
| SENSOR 150a | 1 | 1 | 0 | 0 | 1 |
| SENSOR 150b | 1 | 0 | 0 | 1 | 1 |
| ROTATION DIRECTION OF STEPPING MOTOR AT TIME OF DETECTION | – | CW | | CCW | – |
| ANGLE OF TENSION ROLLER 132 | -2 | -2 | | 2 | 2 |

IMAGE HEATING APPARATUS CONFIGURED TO DETECT BREAKAGES OF LATERAL END PORTIONS OF AN ENDLESS BELT

BACKGROUND OF THE INVENTION

1. Field of the Invention

The present invention relates to an image heating apparatus configured to heat a toner image on a sheet. The image heating apparatus may be used, for example, in an image forming apparatus such as a copying machine, a printer, a facsimile machine, and a multifunction peripheral having a plurality of functions of those apparatuses.

2. Description of the Related Art

Conventionally, there has been proposed a fixing apparatus (image heating apparatus) configured to fix a toner image formed on a sheet by using a heating belt (endless belt).

In the fixing apparatus, repetitive bending of the heating belt may cause a fatigue failure of the heating belt, or some accident may cause a breakage of a lateral end portion of the heating belt (partial breakage may occur from the lateral end portion to a lateral inner side of the heating belt). In case such a breakage occurs in the heating belt, the breakage needs to be immediately detected.

In view of such circumstances, Japanese Patent Application Laid-Open No. 2011-33832 discloses a belt position detecting device for belt lateral movement control, which is provided at one lateral end of the heating belt and configured to detect a breakage on the one lateral end of the heating belt. Furthermore, a breakage on the other lateral end of the heading belt is detected by using the belt position detecting device. To this end, a link mechanism extending from the one lateral end to the other lateral end of the heating belt is provided on the side of the outer surface of the heating belt.

With this, in the image heating apparatus described in Japanese Patent Application Laid-Open No. 2011-33832, the breakages of the heating belt can be properly detected.

However, in an apparatus structure in which a large installation space cannot be secured on the side of the outer surface of the heating belt, it is difficult to employ the belt breakage detecting mechanism described in Japanese Patent Application Laid-Open No. 2011-33832.

SUMMARY OF THE INVENTION

The present invention provides an image heating apparatus configured to easily detect breakages of lateral end portions of an endless belt without requiring a large installation space on the side of an outer surface of the endless belt.

According to an exemplary embodiment of the present invention, there is provided an image heating apparatus including: (i) an endless belt configured to heat a toner image on a sheet; (ii) a heating device configured to heat the endless belt; (iii) an electric power source configured to supply electric power to the heating device; (iv) a fuse configured to shut off the electric power supplied to the electric power source; and (v) a detecting mechanism configured to detect a breakage of one lateral end of the endless belt, the detecting mechanism including, (v-i) a rocking arm configured to rock about a rocking center and be electrically grounded; (v-ii) an urging member configured to urge the rocking arm to cause one end of the rocking arm to contact to an inner surface, adjacent to the one lateral end, of the endless belt; and (v-iii) an electric element provided between the electric power source and the fuse and configured to contact to the other end of the rocking arm with displacement of the one end of the rocking arm toward an outer side of the endless belt with respect to the endless belt.

Further features of the present invention will become apparent from the following description of exemplary embodiments with reference to the attached drawings.

BRIEF DESCRIPTION OF THE DRAWINGS

FIG. 4B is a table showing control operations in response to signals from the belt lateral movement detecting sensor portion.

DESCRIPTION OF THE EMBODIMENTS

First Embodiment

Figure 1:
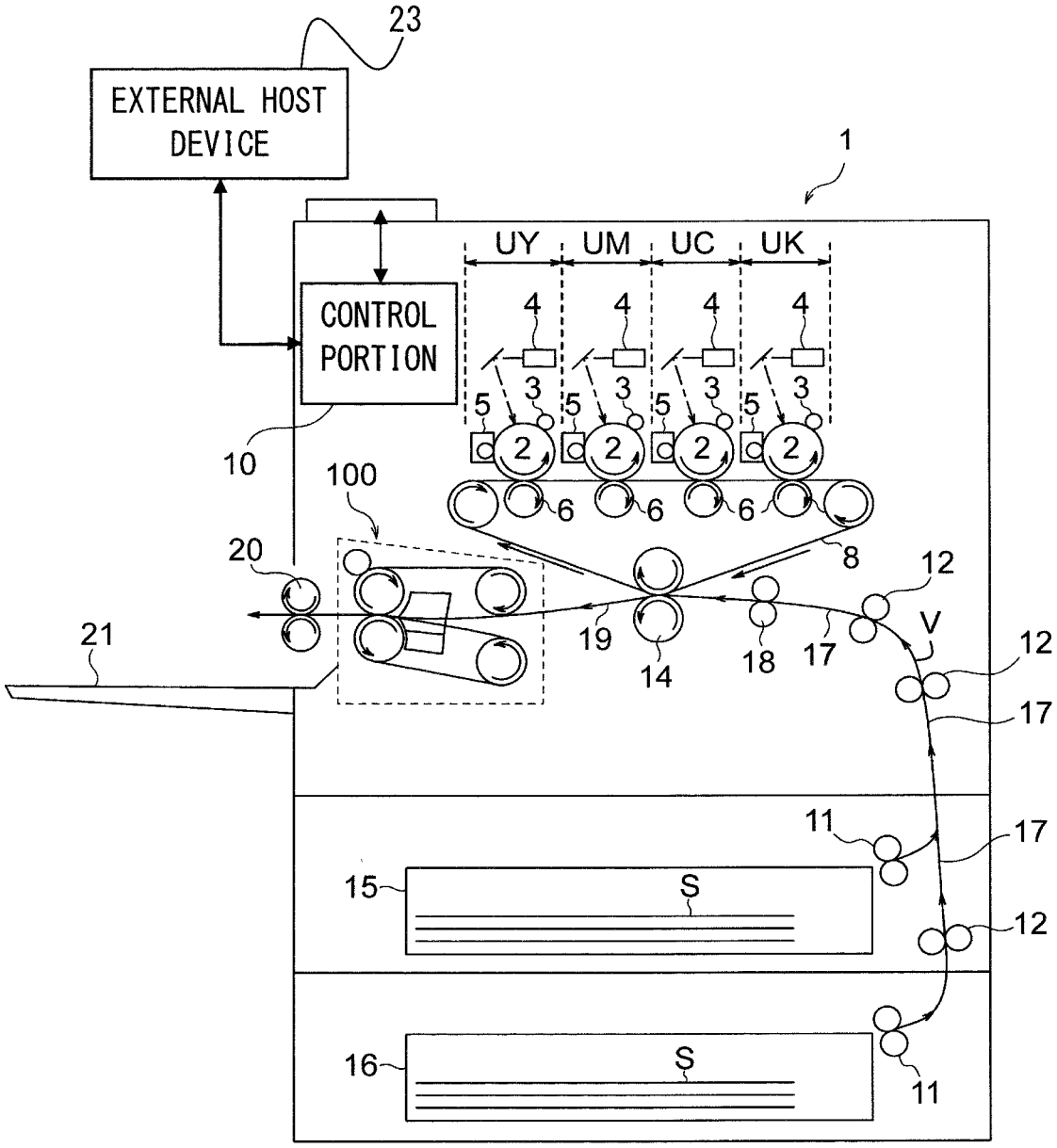
FIG. 1 is a structural view of an image forming apparatus according to a first embodiment.

A first embodiment of the present invention will be described in detail with reference to the drawings. FIG. 1 is a structural view of an image forming apparatus having an image heating apparatus mounted thereto according to the first embodiment.

As illustrated in FIG. 1, an image forming apparatus 1 according to the embodiment includes four image forming portions U (UY, UM, UC, and UK) corresponding to yellow (Y), magenta (M), cyan (C), and black (K), respectively. In each of the image forming portions U, a photosensitive drum (image bearing member) 2 charged by a charging roller 3 is subjected to exposure with a laser beam emitted from a laser scanner 4 according to image information output from an external host device 23. In this way, an electrostatic latent image is formed on the photosensitive drum 2.

The electrostatic latent image thus formed is developed into a toner image of corresponding one of the colors by a developing device 5 with a toner of the corresponding one of the colors. The formed toner images of the corresponding colors are transferred onto an intermediate transfer belt 8 by corresponding primary transfer rollers 6. In this way, a full-color toner image is formed on the intermediate transfer belt 8.

Meanwhile, sheets (recording materials) S stored in cassettes 15 and 16 are each conveyed through a conveying path 17 by feed roller pairs 11, conveyer roller pairs 12, and a registration roller pair 18 toward a nip portion (secondary transfer portion) between the intermediate transfer belt 8 and a secondary transfer roller (transfer unit) 14. The sheet S conveyed to the secondary transfer portion is subjected to secondary transfer of the full-color toner image, and conveyed to a fixing apparatus (image heating apparatus) 100 through a conveying path 19. The fixing apparatus 100 heats and pressurizes the sheet S so as to fix the full-color toner image to the sheet S, and discharges the sheet S onto a discharge tray 21 through a discharge roller pair 20.

(Fixing Apparatus 100)

Figure 2:
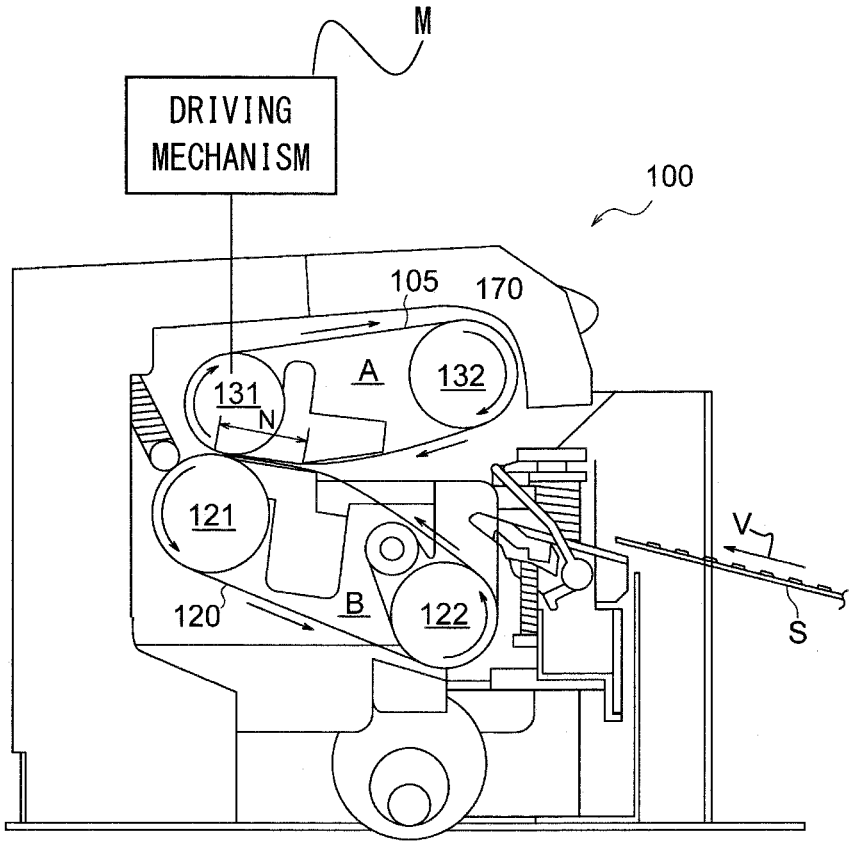
FIG. 2 is a structural view of an image heating apparatus according to the first embodiment.

FIG. 2 is a structural view of the fixing apparatus 100 having a function of the image heating apparatus. As illustrated in FIG. 2, the fixing apparatus 100 includes a heating unit A, a pressure unit B, and an IH heater (heating mechanism) 170. The heating unit A includes a heating belt (endless belt) 105 and a plurality of support rollers configured to support the heating belt 105 in a rotatable manner from an inner surface thereof, that is, a fixing roller 131 and a tension roller 132. The IH heater 170 includes an exciting coil configured to heat the heating belt 105 with induction heating. The pressure unit B includes an endless pressure belt 120, and a pressure roller 121 and a tension roller 122 over which the pressure belt 120 passes.

A driving mechanism M (FIG. 2) including a motor and a gear train drives and rotates the fixing roller 131 so as to rotate the heating belt 105. Further, the pressure belt 120 is rotated by the rotation of the heating belt 105.

The heating belt 105 is liable to be laterally moved (belt lateral movement) to one side or the other side in a lateral direction orthogonal to a sheet conveying direction V during a rotation process thereof. Similarly, the pressure belt 120 which is caused to press-contact to the heating belt 105 so as to form a fixing nip portion N is also liable to be laterally moved.

As a countermeasure, in the embodiment, as described below, there is provided a belt lateral movement control mechanism configured to regulate a travel range in the lateral direction of the heating belt 105 to fall within a predetermined zone. Note that, although not described, the pressure belt 120 also includes a similar belt lateral movement control mechanism.

(Belt Lateral Movement Control Mechanism)

Figure 3:
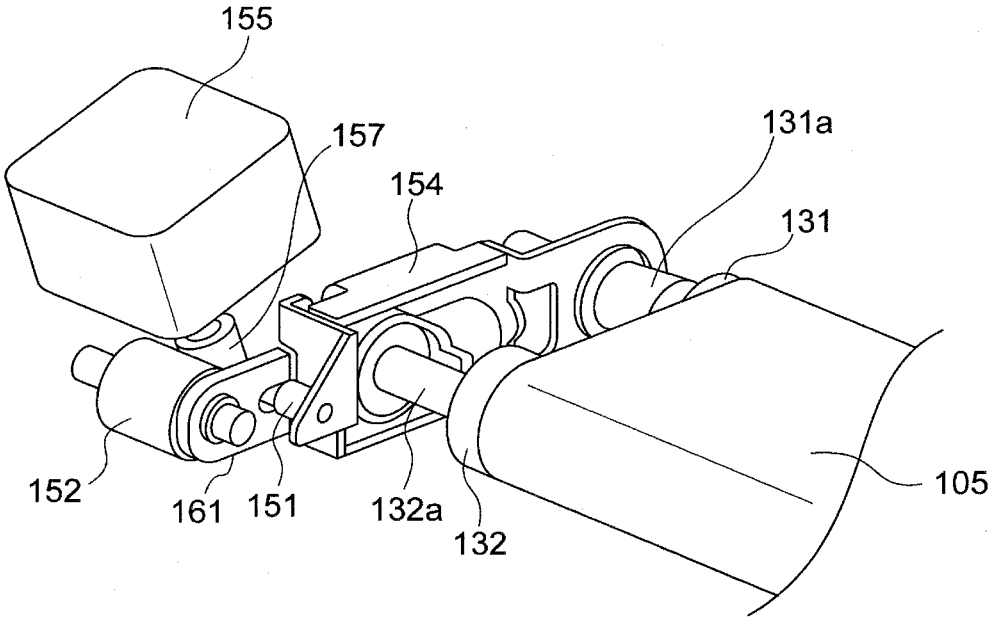
FIG. 3 is a perspective view of a belt lateral movement control mechanism according to the first embodiment.
Figure 4A:
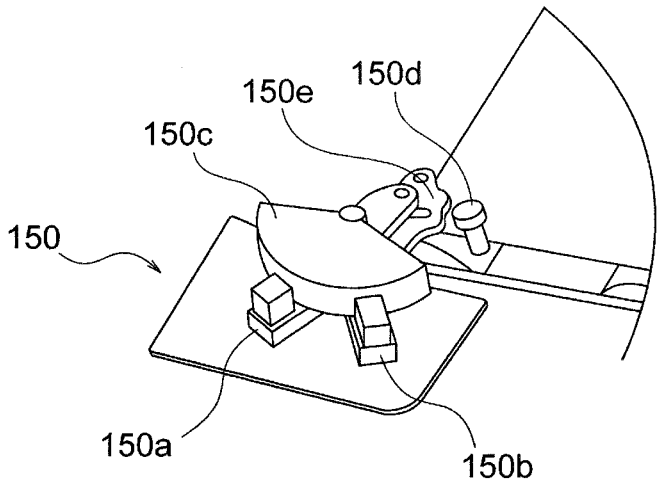
FIG. 4A is a perspective view of a belt lateral movement detecting sensor portion according to the first embodiment.

FIG. 3 is a perspective view of the belt lateral movement control mechanism. FIG. 4A is a perspective view of a belt lateral movement detecting sensor portion (detecting device) 150. FIG. 4B is a table showing the relationships between a lateral position of an end surface of the heating belt 105 and ON/OFF signals output from sensors 150*a* and 150*b*, and how to control the position of the end surface of the heating belt 105.

As illustrated in FIG. 3, at one lateral end of the heating belt 105 of the heating unit A, as the belt lateral movement control mechanism, there are provided a stepping motor 155, a worm 157, a worm wheel 152, a fork plate 161, a pin 151, and a support arm 154.

Further, the heating unit A also includes the belt lateral movement detecting sensor portion 150 (refer to FIG. 4A) provided at the one lateral end of the heating belt 105.

As illustrated in FIG. 4A, the sensor portion 150 includes two sensors 150*a* and 150*b*, a sensor flag 150*c*, a sensor arm 150*d*, and a sensor spring 150*e*. The sensor spring 150*e* generates an urging force to press and cause the sensor arm 150*d* to contact the end surface of the heating belt 105 (one lateral end of the belt). With this, the sensor arm 150*d* is operated in association with the movement in the lateral direction of the heating belt 105.

When the sensor arm 150*d* is moved in the belt lateral direction by the heating belt 105, the sensor flag 150*c* pivots to a position at which the sensor flag 150*c* turns ON and OFF the sensors 150*a* and 150*b*. Based on combinations of ON/OFF signals of each of the sensors 150*a* and 150*b*, the position in the belt lateral direction of the sensor arm 150*d* is detected. In this way, the position of the heating belt 105 is detected.

A signal representing a position of an end portion of the heating belt 105 (position of the laterally moved belt), which is detected by the sensor portion 150, is sent to a control portion (controller) 10 (refer to FIG. 1).

As shown in FIG. 4B, based on detection results of the position of the end portion of the heating belt 105, the control portion 10 rotates the stepping motor 155 in a forward rotation direction (CW) or a reverse rotation direction (CCW) by a predetermined number of revolutions. With this, through intermediation of the worm 157, the worm wheel 152, the fork plate 161, and the pin 151, the support arm 154 is pivoted (displaced) by a predetermined control amount in an upward direction or a downward direction about a shaft 131*a* of the fixing roller 131.

This causes a shaft 132*a* of the tension roller 132 to move upward or downward, and inclination in the lateral direction of the tension roller 132 varies. As a result, the heating belt 105 is moved in the lateral direction. In this way, lateral movement control of the heating belt 105 is performed.

In the embodiment, the lateral movement of the heating belt 105 is stabilized within a predetermined lateral movement range by the swing type lateral movement control. Specifically, the swing type lateral movement control causes the tension roller 132 to be inclined in a direction opposite to a lateral movement direction of the heating belt 105 when the sensor portion 150 detects that the belt position is moved from a lateral central portion by a predetermined amount or more.

Repetition of the swing type lateral movement control causes the heating belt 105 to be periodically moved from one lateral side to the other lateral side, and hence the lateral movement of the heating belt 105 can be stably controlled. In other words, the heating belt 105 is reciprocable in the lateral direction orthogonal to the conveying direction V of the sheet S.

Figure 4C:
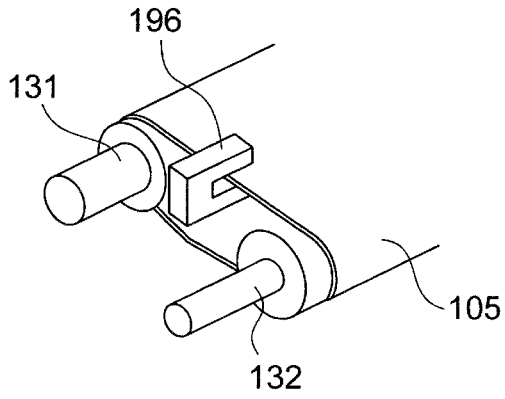
FIG. 4C is a structural view of another belt lateral movement detecting sensor portion according to the first embodiment.

Note that, a transmission type non-contact sensor 196 illustrated in FIG. 4C may be provided instead of the belt lateral movement detecting sensor portion 150 so as to detect the lateral position of the end surface of the heating belt 105.

Figure 5:
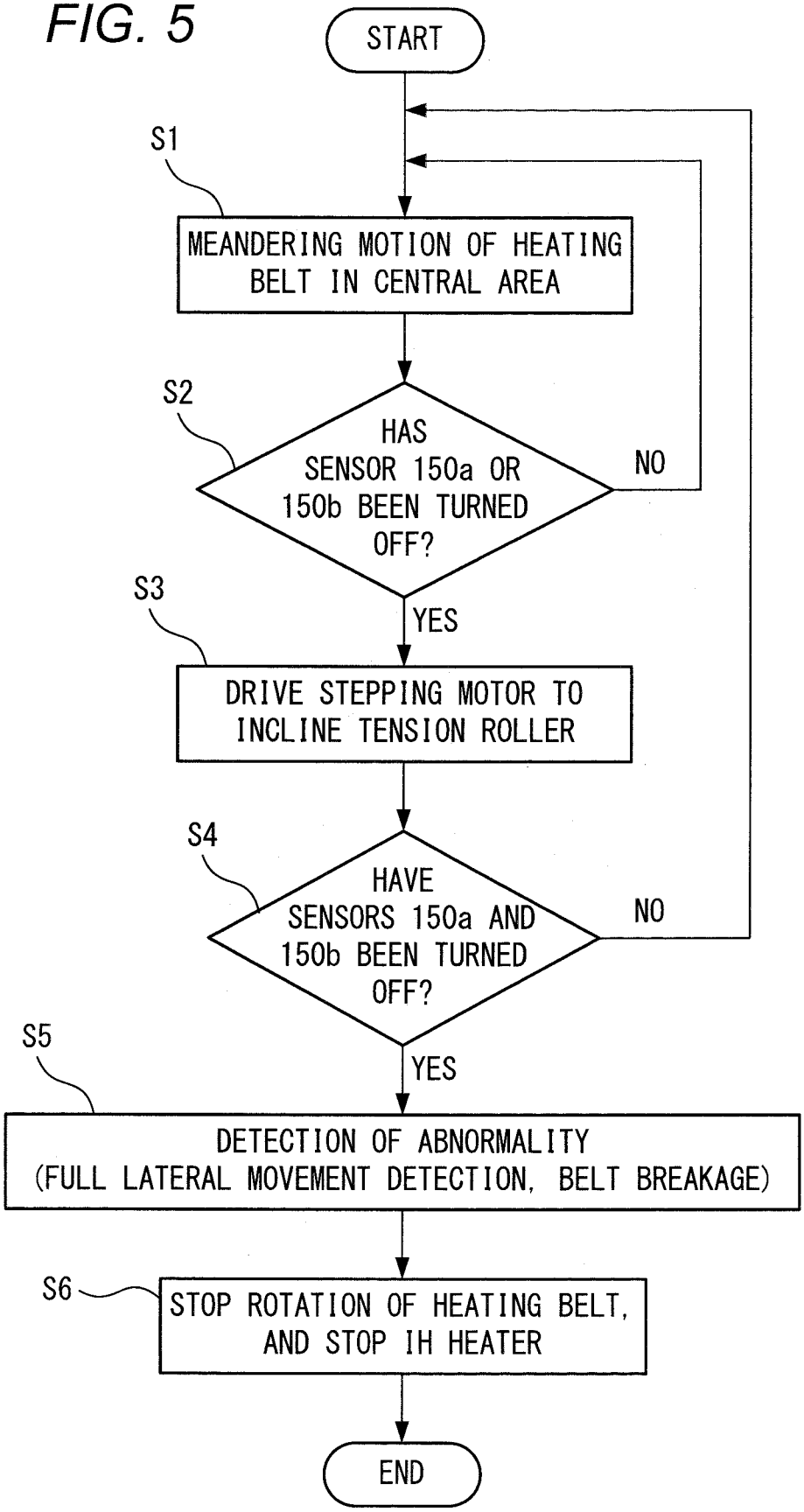
FIG. 5 is a flowchart illustrating lateral movement control on a heating belt according to the first embodiment.

FIG. 5 is a flowchart illustrating the lateral movement control on the heating belt 105. As shown in FIGS. 4B and 5, in a case where a meandering motion of the heating belt 105 in a central area (S1) occurs, when the sensor 150*a* is turned OFF and the sensor 150*b* is turned ON (S2), a position of +1.0 mm from a central position to a far side is detected. In response to a signal of the detection result, the stepping motor 155 is driven in the clockwise (CW) direction so as to incline the tension roller 132 at an angle of −2° to the fixing roller 131 (S3). In other words, the tension roller 132 is displaced.

In contrast, when the sensor 150*a* is turned ON and the sensor 150*b* is turned OFF (S2), a position of −1.0 mm from the central position to a near side is detected. Then, the stepping motor 155 is driven in the counterclockwise (CCW) direction so as to incline the tension roller 132 at an angle of +2° to the fixing roller 131 (S3). With this, the heating belt 105 is moved in a direction in which the heating belt 105 returns to the central area. In this way, the lateral movement control is performed.

When the end surface of the heating belt 105 is moved to a position of +3 mm from the central position or a position of −3 mm from the central position and the lateral movement control is lost, both the sensors 150*a* and 150*b* are turned OFF (S4). Simultaneously, the image forming apparatus 1 determines that some abnormality, such as breakage of the lateral end portion of the heating belt 105, has occurred (S5), and stops heating in the fixing apparatus 100 and the rotation of the heating belt 105 (S6). In other words, based on outputs from the sensors 150*a* and 150*b*, the control portion (controller) 10 stops supply of an electric power to the IH heater (heating mechanism) 170 and the supply of an electric power to the driving mechanism M (FIG. 2) configured to drive and rotate the heating belt 105. As a result, in accordance with the stopping of the rotation of the heating belt 105, the rotation of the pressure belt 120 to be rotated by the rotation of the heating belt 105 is also stopped.

(Detection of Failure of Heating Belt 105)

Figure 6A:
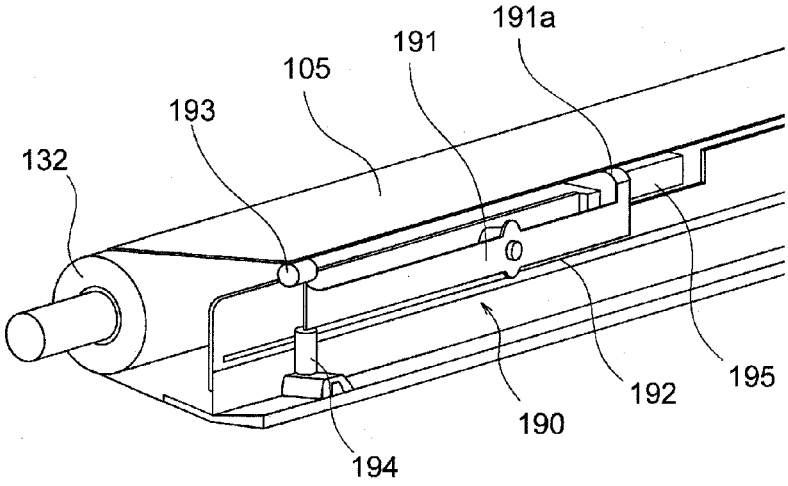
FIG. 6A is a perspective view of a belt failure detecting mechanism according to the first embodiment.
Figure 6B:
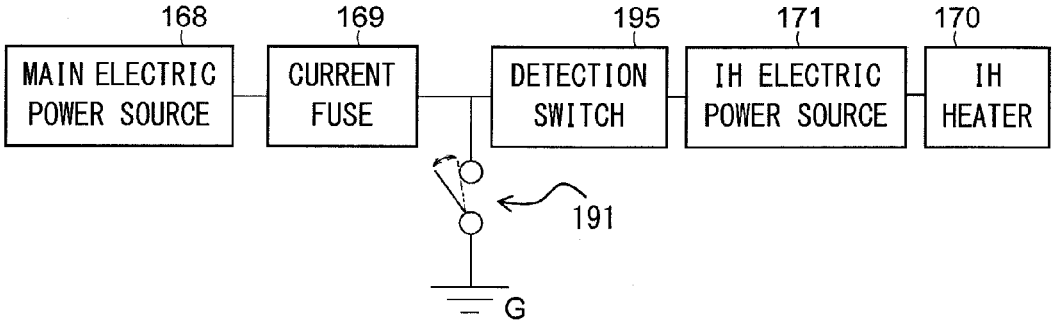
FIG. 6B is a block diagram illustrating how heating is stopped in response to detection of a belt failure.

FIG. 6A is a perspective view of a belt failure detecting mechanism 190 according to the embodiment. FIG. 6B is a block diagram illustrating how heating is stopped in response to detection of a belt failure.

In the embodiment, a failure (breakage) of the one lateral end of the heating belt 105 can be detected by the belt lateral movement control mechanism described above. As a counterpart, a detecting mechanism configured to detect a failure (breakage) of the other lateral end of the heating belt 105 is required. In view of the circumstance, as illustrated in FIG. 6A, the belt failure detecting mechanism 190 configured to detect the failure of the other lateral end of the heating belt 105 is provided at the other lateral end of the heating belt 105.

The belt failure detecting mechanism 190 includes a rocking arm (arm member) 191 electrically connected to a ground contact portion G, an arm end portion 191*a*, a pivot shaft 192, an abutment member 193, an urging member 194, and a detection switch 195. The rocking arm 191 is pivotable (rockable) about the pivot shaft (rocking center) 192. The arm end portion 191*a* is provided at one end of the rocking arm 191, and the abutment member 193 is provided at the other end of the rocking arm 191.

The rocking arm 191, the arm end portion 191*a*, and the pivot shaft 192 are each formed of a conductive member such as SUS. The abutment member 193 contacts to an inner surface of the heating belt 105 and is rotated by the rotation of the heating belt 105. Rotary members excellent in smoothness and rollability, such as a rotatable member made of tetrafluoroethylene (PFA) and a bearing are desirable as the abutment member 193. In the embodiment, a PFA rotatable member having a diameter of 3 mm is used.

The urging member 194 is a compression spring, and urges the abutment member 193 against the inner surface of the heating belt 105 with a force of 100 gf. The detection switch (electric element, or excessive temperature rise preventing element) 195 is a (bimetallic) thermostat switch. As illustrated in FIG. 6B, an electric power is supplied from a main electric power source 168 to an IH electric power source 171 via a current fuse 169 and the detection switch 195. The IH electric power source 171 activates the IH heater 170.

Figure 7A:
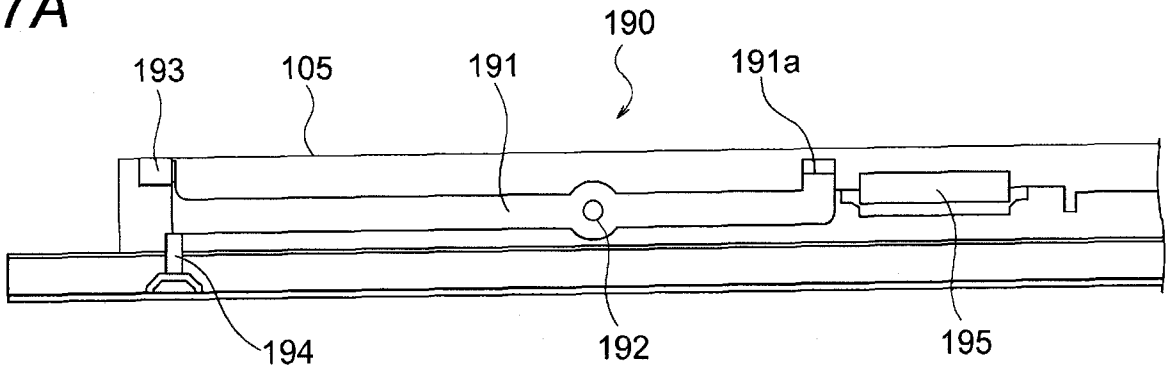
FIG. 7A is a view illustrating a state of the belt failure detecting mechanism during a normal operation.
Figure 7B:
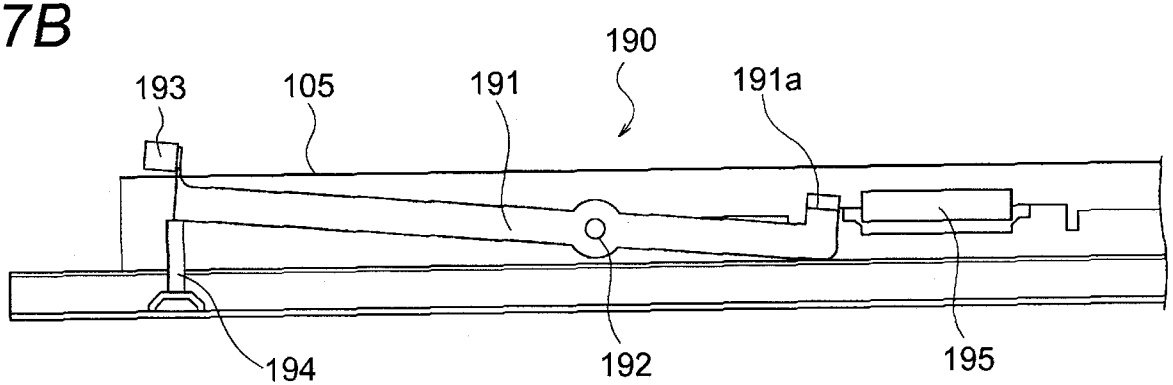
FIG. 7B is a view illustrating a state of the belt failure detecting mechanism at the time of the belt failure.

FIG. 7A is a view illustrating a state of the belt failure detecting mechanism 190 during a normal operation. FIG. 7B is a view illustrating a state of the belt failure detecting mechanism 190 at the time of the belt failure.

As illustrated in FIG. 7A, during the normal operation in which the failure or an abnormality of excessive lateral movement of the heating belt 105 does not occur, the end portion of the heating belt 105 is located on an outside of a heat generating area of the IH heater 170. In other words, none of the fixing roller 131 and the tension roller 132 is exposed in the heat generating area of the IH heater 170. During the normal operation, the rocking arm 191 is located at a first urging position, and the urging member 194 holds the abutment member 193 in contact with the inner surface of the heating belt 105. Meanwhile, the arm end portion 191*a*, which is electrically grounded, does not contact to the detection switch 195.

In other words, as long as the arm end portion 191*a* is located at the first urging position, the detection switch 195 and the ground contact portion G are kept out of contact with each other, and the electric power continues to be supplied from the IH electric power source 171. In this way, the IH heater 170 is operated.

Meanwhile, as illustrated in FIG. 7B, when the failure or the abnormality of excessive lateral movement of the heating belt 105 occurs, the end portion of the heating belt 105 comes into the heat generating area of the IH heater 170. In other words, the fixing roller 131 or the tension roller 132 is exposed in the heat generating area of the IH heater 170. In this state, the abutment member 193 cannot contact the heating belt 105 so that the abutment member 193 is pushed up by the urging member 194. In this way, the rocking arm 191 pivots about the pivot shaft 192 up to a second urging position, and the arm end portion 191*a*, which is electrically grounded, contacts the detection switch 195. In other words, one end of the rocking arm 191, specifically, the abutment member 193, shifts to the side of an outer surface of the heating belt 105 with respect to the heating belt 105, and the other end of the rocking arm 191, specifically, the arm end portion 191*a*, contacts the detection switch 195.

As long as the arm end portion 191*a* is located at the second urging position, the arm end portion 191*a* connected to the ground contact portion G is held in contact with the detection switch 195 and remains short-circuited. As a result, the supply of the electric power to the IH electric power source 171 is stopped, and hence the operation of the IH heater 170 is stopped. Specifically, when the arm end portion 191*a* contacts the detection switch 195, the current fuse 169 provided to the fixing apparatus 100 is blown. In this way, heating of the image heating apparatus 100 can be stopped. Further, in a circuit configuration of the embodiment, when the current fuse 169 is blown, the supply of the electric power from the IH electric power source 171 to the driving mechanism M for the heating belt 105 is also automatically shut off. In other words, the rotation of the pressure belt 120 to be rotated by the rotation of the heating belt 105 is also stopped.

According to the embodiment, even when a large installation space cannot be secured on the outer surface of the heating belt 105, the breakage of each of the lateral end portions of the heating belt 105 can be easily detected.

Further, the belt failure detecting mechanism 190 of the embodiment is provided with a safeguard independent of a CPU of the control portion 10. Thus, even in case the CPU fails and loses control, the heating of the fixing apparatus 100 and the rotation of the heating belt 105 can be stopped.

Second Embodiment

Figure 8:
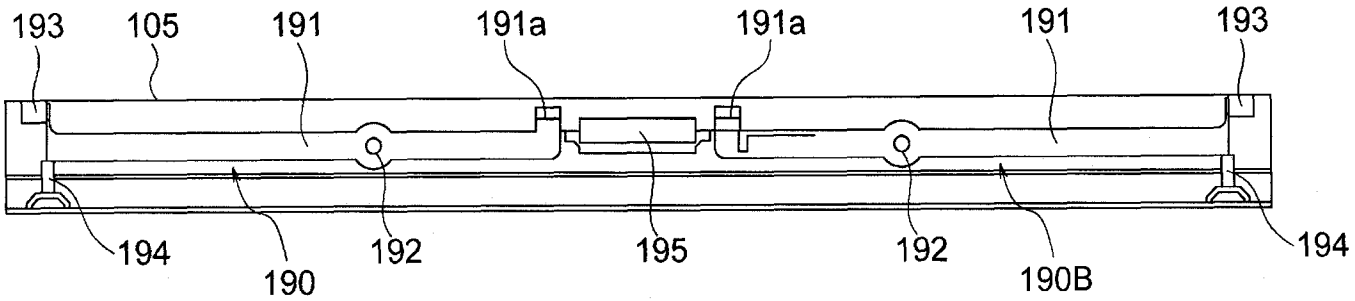
FIG. 8 is a view illustrating a state of a belt failure detecting mechanism according to a second embodiment during a normal operation.

Next, an image heating apparatus and an image forming apparatus according to a second embodiment of the present invention will be described with reference to the drawings. The same parts as those described above in the first embodiment are denoted by the same reference symbols, and description thereof is omitted. FIG. 8 is a view illustrating a state of belt failure detecting mechanisms 190 and 190B according to the embodiment during a normal operation.

As illustrated in FIG. 8, the fixing apparatus 100 as the image heating apparatus of the embodiment is different from the fixing apparatus 100 of the first embodiment described above in that a belt failure detecting mechanism 190B is provided instead of the belt lateral movement detecting sensor portion 150.

Similarly to the belt failure detecting mechanism 190 of the first embodiment described above, the belt failure detecting mechanism 190B includes the rocking arm 191, the arm end portion 191*a*, the pivot shaft 192, the abutment member 193, and the urging member 194, and detects a failure of the other end of the heating belt 105. The belt failure detecting mechanisms 190 and 190B detect failures of both the lateral end portions of the heating belt 105, respectively. With this, states of both the lateral ends of the heating belt 105 can be detected.

According to the embodiment, even when a large installation space cannot be secured on the side of the outer surface of the heating belt 105, the breakage of each of the lateral end portions of the heating belt 105 can be easily detected.

The components of the image heating apparatus of the present invention, which are described above in each of the first embodiment and the second embodiment, may be replaced with various other known components within the spirit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-097326, filed Apr. 23, 2012, which is hereby incorporated by reference herein in its entirety.

What is claimed is:

1. An image heating apparatus comprising:

(i) an endless belt configured to heat a toner image on a sheet;

(ii) a heating device configured to heat said endless belt;

(iii) an electric power source configured to supply electric power to said heating device;

(iv) a fuse configured to shut off the electric power supplied to said electric power source; and (v) a detecting mechanism configured to detect a breakage of one lateral end of said endless belt, said detecting mechanism including, (v-i) a rocking arm configured to rock about a rocking center and be electrically grounded;

(v-ii) an urging member configured to urge said rocking arm to cause one end of said rocking arm to contact to an inner surface, adjacent to the one lateral end, of said endless belt; and (v-iii) an electric element provided between said electric power source and said fuse and configured to contact the other end of said rocking arm with displacement of the one end of said rocking arm toward an outer side of said endless belt with respect to said endless belt.

2. An image heating apparatus according to claim 1, further comprising a driving mechanism configured to receive the electric power supplied from said electric power source to drive and rotate said endless belt.

3. An image heating apparatus according to claim 1, further comprising:

a support roller configured to support said endless belt in a rotatable manner;

a detecting device configured to detect a position of the other lateral end of said endless belt;

a displacement mechanism configured to displace said support roller based on an output from said detecting device so as to keep said endless belt within a predetermined zone in a lateral direction of said endless belt; and another detecting mechanism configured to detect a breakage of the other lateral end of said endless belt, wherein said another detecting mechanism detects the breakage of the other lateral end of said endless belt by using the output from said detecting device.

4. An image heating apparatus according to claim 3, further comprising a controller configured to shut off the electric power supplied to said electric power source when said another detecting mechanism detects the breakage of the other lateral end of said endless belt.

5. An image heating apparatus according to claim 4, further comprising a driving mechanism configured to receive the electric power supplied from said electric power source to drive and rotate said endless belt.

6. An image heating apparatus according to claim 1, wherein a rotary member configured to contact to the inner surface, adjacent to the one lateral end, of said endless belt is provided on the one end of said rocking arm.

7. An image heating apparatus according to claim 1, wherein said fuse comprises a current fuse configured to shut off the electric power supplied to said electric power source by being blown when said electric element contacts the other end of said rocking arm.

8. An image heating apparatus according to claim 1, wherein said electric element comprises an excessive temperature rise preventing element provided in contact with the inner surface of said endless belt.

9. An image heating apparatus according to claim 8, wherein said excessive temperature rise preventing element comprises a thermostat switch.

10. An image heating apparatus according to claim 1, wherein said heating device comprises an exciting coil configured to heat said endless belt with induction heating.

* * * * *